United States Patent [19]

Ishimaru et al.

[11] 4,434,620

[45] Mar. 6, 1984

[54] CONDENSATION SYSTEM FOR POWER PLANT

[75] Inventors: Hitoshi Ishimaru; Yoji Nagai; Toyohiko Masuda, all of Hitachi, Japan

[73] Assignees: Hitachi, Ltd.; Hitachi Engineering Co., Ltd., both of Tokyo, Japan

[21] Appl. No.: 393,335

[22] Filed: Jun. 29, 1982

[30] Foreign Application Priority Data

Jul. 8, 1981 [JP] Japan ..... 56-105545

[51] Int. Cl.[3] ..... F01K 19/00

[52] U.S. Cl. ..... 60/657; 60/692

[58] Field of Search ..... 60/646, 657, 685, 692

[56] References Cited

U.S. PATENT DOCUMENTS 4,055,048 10/1977 Reed ..... 60/657 X 4,353,213 10/1982 Masuda et al. ..... 60/646

4,365,476 12/1982 Masuda et al. ..... 60/657 X

*Primary Examiner*—Allen M. Ostrager

*Assistant Examiner*—Stephen F. Husar

*Attorney, Agent, or Firm*—Antonelli, Terry & Wands

[57] ABSTRACT

A condensation system for use in a power plant including a steam generator and steam turbine comprises at least one side stream condenser. The side stream condenser defines therein first and second hot wells with the first hot well receiving therein condensate produced by condensing steam exhausted from the steam turbine. A condensate pump device forcibly delivers the condensate through a condensate feed line having one end thereof connected to the first hot well and the other end communicating with the second hot well. A first purification device is provided in the condensate feed line to remove impurities from the condensate flowing therethrough. A main condensate pump device forcibly delivers the condensate through a main condensate feed line having one end thereof communicating with the condensate feed line and the other end connected to the steam generator. A second purification device is provided in the main condensate feed line downstream of the main condensate pump device, for removing impurities from the condensate introduced into the steam generator through the main condensate feed line.

12 Claims, 1 Drawing Figure

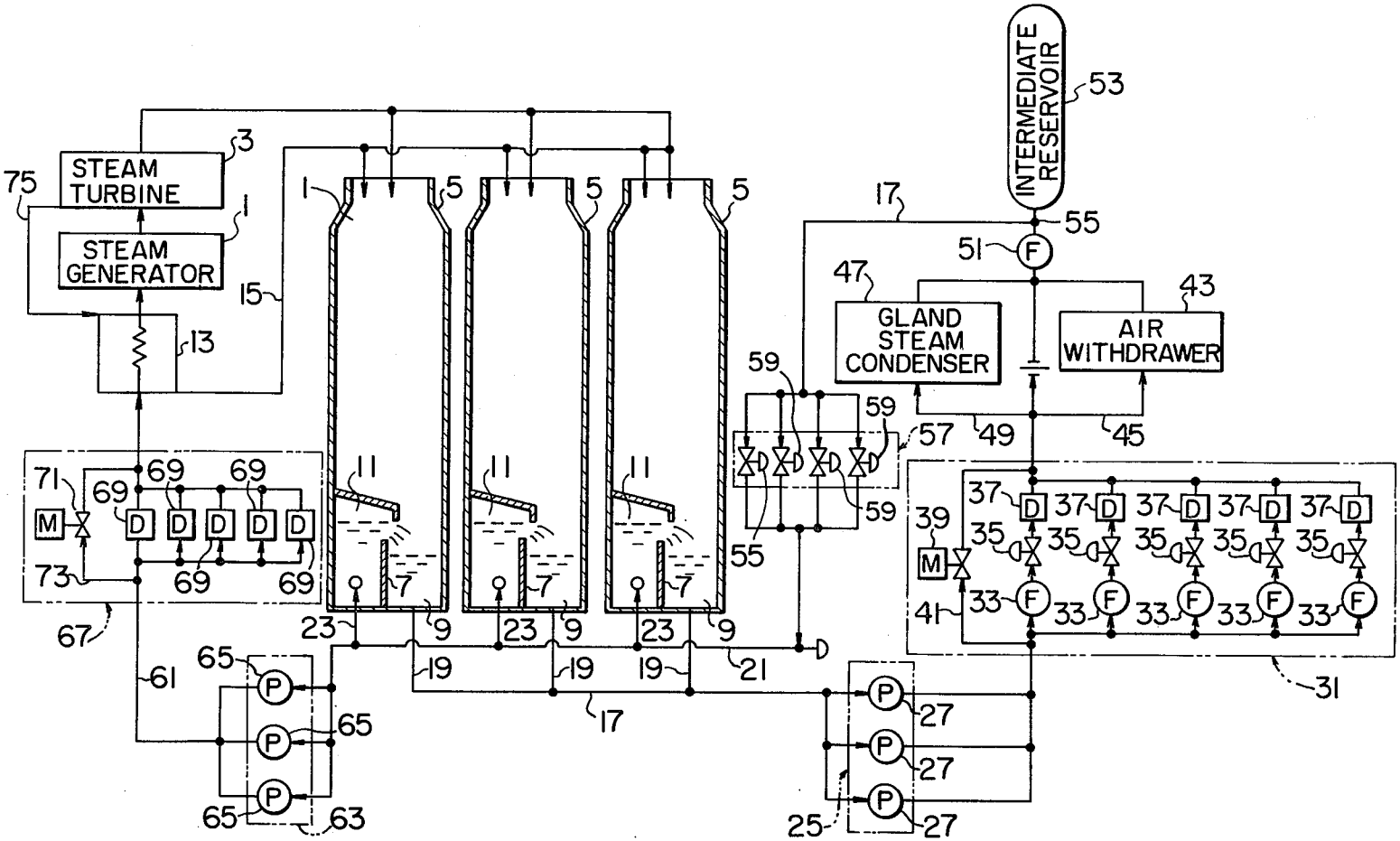
INTERMEDIATE RESERVOIR
AIR WITHDRAWER
GLAND STEAM CONDENSER
STEAM TURBINE
STEAM GENERATOR

CONDENSATION SYSTEM FOR POWER PLANT

BACKGROUND OF THE INVENTION

1. Field of the Invention

The present invention relates to a condensation system for use in a power plant including a steam generator and a steam turbine, and more particularly to a condensation system comprising at least one side stream condenser defining therein first and second hot wells with the first hot well receiving therein condensate produced by condensing steam exhausted from the steam turbine.

2. Description of the Prior Art

A condensation system of the kind referred to above is disclosed in Japanese Patent Laying-Open No. 61589/81 laid open for public inspection on May 27, 1981. The condensation system disclosed in the Japanese patent laying-open publication includes a condensation feed line having one end thereof connected to the first hot well of the side stream condenser and the other end connected to the second hot well thereof, and a condensate pump device provided in the condensate feed line for forcedly delivering the condensate from the first hot well to the second hot well through the condensate feed line. A first purification device comprising a filteration type demineralizer is disposed in the condensate feed line downstream of the condensate pumping device for removing impurities from the condensate flowing through the condensate feed line. A second purification device comprising a mixed-bed type demineralizer is disposed in the condensate feed line downstream of the first purification device, for removing impurities from the condensate flowing through the condensate feed line. An air-withdrawer is connected to the condensate feed line in parallel thereto downstream of the second purification device, for condensing steam which is utilized to actuate a steam ejector so as to withdraw incondensable gas out of the side stream condenser. A gland-steam condenser is connected to the air-withdrawer in parallel thereto, for condensing steam enclosed within gland portions of the steam turbine and valves.

In the condensation system of the prior art described above, corroded substances contained in the condensate received in the first hot well of the side stream condenser and corroded substances produced in a portion of the condensate feed line upstream of the first and second purification devices are removed by the first and second purification devices.

However, corroded substances produced in a portion of the condensate feed line downstream of the second purification device, and corroded substances produced in the gland-steam condenser, the air-withdrawer, the main condensate pump device and the main condensate feed line having provided therein the main condensate pump device are introduced into the steam generator through the main condensate feed line as they are.

If the power plant is a thermoelectric power plant, the corroded substances introduced into the steam generator cause scale deposited on a boiler of the steam generator to be increased to decrease the performance of the boiler.

If the power plant is a nuclear power plant, the corroded substances introduced into a nuclear reactor of the steam generator become radionuclides, and the surface dose rate from the condensate feed lines and the like is increased to increase the exposure dose on operators during the inspection and maintenance. One of the serious or significant problems in the nuclear power plant of today is the improvement in quality of the condensate. A great deal of effort is concentrated on the countermoves to this problem and the reduction in exposure dose is the problem which is required to be solved by all means. Accordingly, in the condensation system of the prior art, it is a serious or significant problem that a considerable amount of corroded substances is introduced into the nuclear reactor, that is, the total iron concentration in the condensate is high and the condensate is poor in quality.

SUMMARY OF THE INVENTION

An object of the present invention is to provide a condensation system for use in a power plant, which enables the impurities in the condensate to be reduced in amount which is introduced into the steam generator.

According to the present invention, there is provided a condensation system for use in a power plant including a steam generator and a steam turbine, comprising: at least one side stream condenser defining therein first and second hot wells, the first hot well receiving therein condensate produced by condensing steam exhausted from the steam turbine; a condensate feed line having one end thereof connected to the first hot well and the other end communicating with the second hot well; condensate pump means provided in the condensate feed line for forcibly delivering the condensate through the condensate feed line from the first hot well; first purification means provided in the condensate feed line for removing impurities from the condensate flowing through the condensate feed line; a main condensate feed line having one end thereof communicating with the condensate feed line and the other end connected to the steam generator; main condensate pump means provided in the main condensate feed line for forcibly delivering the condensate through the main condensate feed line; and second purification means provided in the main condensate feed line downstream of the main condensate pump means for removing impurities from the condensate flowing through the main condensate feed line.

BRIEF DESCRIPTION OF THE DRAWING

A single FIGURE is a schematic view illustrating a condensation system in accordance with an embodiment of the present invention.

DETAILED DESCRIPTION OF THE PREFERRED EMBODIMENT

Referring to the single FIGURE there is schematically shown a condensation system for use in a power plant which includes a steam generator 1 and steam turbine 3. The condensation system includes side stream condensers 5 each of which has a partition wall 7 for defining first and second hot wells 9 and 11 within the side stream condenser. The first hot well 9 receives therein condensate produced by condensing steam exhausted from the steam turbine 3 and drain flowing from a feed water heater 13 through a line 15.

A condensate feed line 17 has one end thereof communicating with the first hot wells 9 of the side stream condensers 5 through branch lines 19, respectively and the other end connected to a suction header 21 communicating with the second hot wells 11 of the side stream condensers 5 through branch lines 23, respectively. A pump device 25 comprising a plurality of pumps 27 connected in parallel to each other is provided in the condensation feed line 17 for forcedly delivering the condensate from the first hot well 9 to the suction header 21. A first purification device 31 is provided in the condensate feed line 17 downstream of the pump device 25 and comprises a plurality of purificating units connected in parallel to each other. Each of the purificating units includes a flow detector 33, flow control valve 35 and filteration type demineralizer 37 which are connected in series to each other. The filteration type demineralizers 37 remove impurities from the condensate flowing through the condensate feed line 17, particularly, corroded substances suspended in the condensate therefrom. A motor-actuated valve 39 is provided in a bypass passage 41 bypassing the purificating units, and allows the condensate to flow so as to bypass the purificating units, if necessary.

An air-withdrawer 43 is located downstream of the first purification device 31 and is provided in a bypass passage 45 for condensing steam utilized to actuate a not-shown steam ejector. A gland-steam condenser 47 is provided in a bypass passage 49 connected in parallel to the bypass passage 45 having provided therein the air-withdrawer 43, for condensing steam enclosed within gland portions of the steam turbine 3 and valves not shown. A flow detector 51 is provided in the condensate feed line 17 downstream of the gland-steam condenser 47 and the air-withdrawer 43, for detecting the flow rate of the condensate passing through the condensate feed line 17.

An intermediate reservoir 53 is located at the highest level of the condensation system and is connected at 55 to the condensate feed line 17 downstream of the flow detector 51. A level-control valve device 57 comprising a plurality of valves 59 connected in parallel to each other is provided in the condensate feed line 17 downstream of the connection 55 and is operative to constantly maintain the liquid level within the intermediate reservoir to a constant level.

A main condensate feed line 61 and one end thereof connected to the suction header 21 and the other end connected to the steam generator 1. A main condensate pump device 63 comprising a plurality of pumps 65 connected in parallel to each other is provided in the main condensate feed line 61 for forcibly delivering the condensate at the flow rate required in accordance with the operating load of the electric power plant, to the steam generator 1 from the suction header 21. The remaining condensate is returned from the suction header 21 to the second hot wells 11 through the branch lines 23. A second purification device 67 is provided in the main condensate feed line 61 downstream of the main condensate pump device 63 and comprises a plurality of mixed-bed type demineralizers 69 connected in parallel to each other. The mixed-bed type demineralizers 69 remove impurities from the condensate flowing through the main condensate feed line 61, particularly, impurities solved in the condensate and corroded substances suspended in the condensate. A motor-actuated valve 71 is provided in a bypass passage 73 bypassing the mixed-bed type demineralizers 69, and allows the condensate to flow so as to bypass the mixed-bed type demineralizers 69, if necessary.

Steam withdrawn from the steam turbine 3 through a line 75 is introduced into the feed water heater 13 to heat the condensate passing through the main condensate feed line 61. As also described previously, the steam after having heated the condensate passing through the main condensate feed line 61 is introduced, as drain, into the first hot wells 9 of the side stream condensers 5 through the line 15.

In operation, the condensate within the first hot wells 9 of the side stream condensers 5 is delivered through the branch lines 19 and the condensate feed line 17 by the pump device 25. The condensate flowing through the condensate feed line 17 enters the first purification device 31 where the impurities such as corroded substances suspended in the condensate are removed. The condensate from the first purification device 31 passes through the gland-steam condenser 47 and the air-withdrawer 43 and is elevated in temperature by the heat-exchange performed in the gland-steam condenser and the air-withdrawer. The condensate having its elevated temperature is introduced into the suction header 21 through the level-control valve device 57. A portion of the condensate introduced into the suction header which is required in accordance with the operating load of the electric power plant is delivered through the main condensate feed line 61 by the main condensate pump device 63, and the remaining condensate is introduced into the second hot wells 11 of the side stream condensers 5 through the branch lines 23 and is overflowed from the upper edges of the partition walls 7 so as to be returned into the first hot wells 9.

The condensate delivered through the main condensate feed line 61 by the main condensate pump device 63 is introduced into the second purification device 67 where the impurities solved in the condensate and the impurities such as corroded substances suspended in the condensate are removed therefrom. The condensate having the impurities removed is heated by the steam withdrawn from the steam turbine 3 during the passage of the condensate through the feed water heater 13. The heated condensate enters the steam generator 1 where the condensate is converted into steam under high temperature and pressure. The steam under high temperature and pressure is introduced into the steam turbine 3 and is expanded therein so that the energy which the steam has is converted into a mechanical energy to drive a hot shown generator, for example. The steam after having been expanded from the steam turbine 3 is introduced into the side stream condensers 5 and is condensed thereby. The condensed steam or condensate is received in the first hot wells 9. Thus, one cycle is completed.

It will be seen from the foregoing that in the condensation system in accordance with the embodiment of the present invention, the corroded substances contained in the condensate within the first hot wells 9 of the side stream condensers 5 and the corroded substances produced in a portion of the condensate feed line 17 upstream of the first purification device 31 are removed by the first purification device. In addition, the corroded substances produced in a portion of the condensate feed line 17 downstream of the first purification device 31, the corroded substances produced in the air-withdrawer 43 and the gland-steam condenser 47, the corroded substances produced in the suction header 21, the corroded substances produced in the main condensate pump device 63 and the corroded substances produced in a portion of the main condensate feed line 61 upstream of the second purification device 67 are removed by the second purification device.

Thus, since the corroded substances produced downstream of the first purification device 31 are removed by the second purification device 67, the corroded substances in the condensate introduced into the steam generator 1 is considerably decreased in amount. In other words, the disposition of the second purification device 67 adjacent to the steam generator 1 enables the condensate introduced thereinto to be improved in quality.

The improvement in quality of the condensate in the condensation system in accordance with the embodiment of the present invention will be tried to be counted or calculated. The corroded substances produced at the system area from the gland-steam condenser 47 and the air-withdrawn to the outlet is approximately 240 (Fe Kg/year). In the prior art condensation system discussed in "DESCRIPTION OF THE PRIOR ART", all of the corroded substances of such approximately 240 (Fe Kg/year) are introduced into the steam generator. To the contrary, in the condensation system in accordance with the embodiment of the present invention, because the second purification device 67 is disposed in the main condensate feed line 61 downstream of the main condensate pump device 63, the corroded substances introduced into the steam generator 1 can be reduced to the level of at most approximately 50 (Fe Kg/year). The decrease in amount of the corroded substances introduced into the steam generator 1, if the power plant is a thermoelectric power plant, causes the scale deposited on the inner wall of the boiler of the steam generator to be reduced to improve the performance of the boiler.

Moreover, the reduction in amount of the corroded substances introduced into the steam generator 1, if the power plant is a nuclear power plant, does mean the decrease in amount of the corroded substances introduced into a nuclear reactor. The decrease in amount of the corroded substances introduced into the nuclear reactor causes the surface dose rate from condensate feed lines and the like to be reduced to decrease the exposure dose on the operators during the periodical or routine inspection. This reduces the total number of operators required for the periodical or routine inspection. If the reduction in exposure dose on the operators during the periodical or routine inspection is converted into the cost or expense required for the periodical or routine inspection, the cost or expense is reduced approximately 2300 (M yen/year/reactor), and the economy is greatly improved.

Furthermore, the maximum allowable working pressure of the condensation system illustrated in the drawing is determined by the net pump head at no-discharge of the condensation device 25, with a margin. The rating net pump head of the condensation pumping device 25 is determined by the hydrostatic pressure of the condensate within the first hot wells 9 of the side stream condensers, the hydrostatic pressure loss at the first purification device 31, the gland-steam condenser 47, the air-withdrawer 43, the flow detector 51 and the level-control valve 57, and the pressure loss through the condensate feed line 17. In case where the second purification device is disposed in a portion of the condensate feed line between the first purification device and the gland-steam condenser and the air-withdrawer, as is in the prior art condensation system described previously, the pressure loss at the first and second purification devices occupies more than half the total pressure loss in the condensation system. This causes the maximum allowable working pressure in the condensation system to be increased. Further, the intermediate reservoir 53 is required to be located above the highest level of the condensation system, for the purpose of preventing the flash from occuring in the condensation feed line 17. In case where the second purification device is located between the first purification device and the gland-steam condenser and the air-withdrawer, as is in the prior art condensation system described previously, the second purification device is frequently located at the maximum level. This causes the hydrostatic pressure to be increased, causes the rating net pump head of the condensate pumping device to be increased, and causes the maximum allowable working pressure in the condensation system to be increased. The increase in maximum allowable working pressure causes the rating of each of the valves incorporated in the first and second purification system to be risen, and the economy is deteriorated.

In the condensation system in accordance with the embodiment of the present invention, since the second purification device is removed from the upstream side of the intermediate reservoir, the head of the condensate pumping device 25 is lowered, the maximum allowable working pressure in the condensation system is lowered, the rating of each of the valves is decreased, and the economy is considerably improved. In addition, the intermediate reservoir is disposed above the highest point of the condensation system, for the purpose of application of pressure to the condensation system by the hydrostatic pressure. As indicated previously, the highest point of the prior art condensation system is frequently located at the second purification device disposed between the first purification device and the gland-steam condenser and the air-withdrawer. In the condensation system in accordance with the embodiment of the present invention, however, because the second purification device is removed from the upstream side of the intermediate reservoir 53, it is made possible to dispose the intermediate reservoir 53 below the operating floor surface. This decreases the head of the condensate pump device, reduces the maximum allowable working pressure of the condensation system, and improves the economy.

The second purification device 67 may be disposed between the feed water heater 13 and the steam generator 1. In such case, the condensate introduced into the steam generator is further improved in quality. The reason for this is that the corroded substances produced in the feed water heater 13 may be removed by the second purification device 67.

What we claim is:

1. A condensation system for use in a power plant including a steam generator and a steam turbine, comprising:

at least one side stream condenser defining therein first and second hot wells, said first hot well receiving therein condensate produced by condensing steam exhausted from said steam turbine;

a condensate feed line having one end thereof connected to said first hot well and the other end communicating with said second hot well;

condensate pump means provided in said condensate feed line for forcibly delivering the condensate through said condensate feed line from said first hot well;

first purification means provided in said condensate feed line for removing impurities from the condensate flowing through said condensate feed line;

a main condensate feed line having one end thereof communicating with said condensate feed line and the other end connected to said steam generator;

main condensate pump means provided in said main condensate feed line for forcibly delivering the condensate through said main condensate feed line; and second purification means provided in said main condensate feed line downstream of said main condensate pump means for removing impurities from the condensate flowing through said main condensate feed line.

2. A condensation system defined in claim 1, wherein said first purification means is disposed downstream of said condensate pump means.

3. A condensation system defined in claim 2, further comprising a gland-steam condenser provided in said condensate feed line downstream of said first purification means for condensing steam enclosed within gland portions of said steam generator.

4. A condensation system defined in claim 3, further comprising an air-withdrawer provided in said condensate feed line downstream of said first purification for condensing steam utilized to withdraw incondensable gas out of said side stream condenser.

5. A condensation system defined in claim 4, wherein said gland-steam condenser and said air-withdrawer are connected to said condensate feed line in parallel to each other.

6. A condensation system defined in claim 5, further comprising an intermediate reservoir connected to said condensate feed line downstream of said gland-steam condenser and said air-withdrawer to prevent a flash from occuring in said condensate feed line.

7. A condensation system defined in claim 6, further comprising valve means provided in said condensate feed line downstream of the location at which said intermediate reservoir is connected to said condensate feed line, for maintaining constant a level of liquid within said intermediate reservoir.

8. A condensation system defined in claim 7, further comprising a suction header connected to said second hot well, said the other end of said condensate feed line being connected to said suction header, said one end of said main condensate feed line being connected to said suction header.

9. A condensation system defined in any one of claims 1–8, further comprising a feed water heater provided in said main condensate feed line between said steam generator and said second purification means.

10. A condensation system defined in claim 9, wherein said first purification means comprises a plurality of filteration type demineralizers to mainly removing the impurities suspended in the condensate from the condensate flowing through said condensate feed line.

11. A condensation system defined in claim 9, wherein said second purification means comprises a plurality of mixed-bed type demineralizers for removing the impurities dissolved in the condensate and the impurities suspended therein from the condensate flowing through said main condensate feed line.

12. A condensation system defined in claim 9, wherein said first purification means comprises a plurality of filteration type demineralizers for removing corroded substances from the condensate flowing through said condensate feed line, and wherein said second purification means comprises a plurality of mixed-bed type demineralizers for removing corroded substances from the condensate flowing through said main condensate feed line.

* * * * *